United States Patent [19]

Tomita

[11] Patent Number: 4,610,053

[45] Date of Patent: Sep. 9, 1986

[54] DEVICE FOR SEALING COIN CONTAINING BAG OR THE LIKE

[76] Inventor: Sumio Tomita, 1-15, 3-chome, Higashitoyonaka-cho, Toyonaka-shi, Japan

[21] Appl. No.: 613,124

[22] Filed: May 23, 1984

[30] Foreign Application Priority Data

| | | | |
|---|---|---|---|
| May 23, 1983 | [JP] | Japan | 58-91349 |
| Jun. 15, 1983 | [JP] | Japan | 58-108367 |
| Aug. 12, 1983 | [JP] | Japan | 58-148379 |
| Dec. 29, 1983 | [JP] | Japan | 58-246607 |

[51] Int. Cl.[4] ..... B65D 77/10

[52] U.S. Cl. ..... 24/30.5 R; 24/136 R

[58] Field of Search ..... 24/481, 32.5 R, 115 H, 24/115 M, 117 R, 136 R, 136 K, 32.5 V; 403/211, 374; 292/325

[56] References Cited

U.S. PATENT DOCUMENTS

| | | | |
|---|---|---|---|
| 696,413 | 4/1902 | Dalrymple | 24/136 K |
| 1,368,545 | 2/1921 | Childers | 24/30.5 R |
| 1,396,479 | 11/1921 | Tyden | 24/30.5 R |
| 1,398,638 | 11/1921 | Graham, Jr. | 24/30.5 R X |
| 2,163,660 | 6/1939 | Brooks | 24/30.5 R |
| 3,165,801 | 1/1965 | Stansbury, Jr. et al. | 24/30.5 R X |
| 3,953,144 | 4/1976 | Boden | 24/115 M X |
| 4,379,358 | 4/1983 | Wibrow | 24/115 M X |

FOREIGN PATENT DOCUMENTS

| | | | |
|---|---|---|---|
| 149800 | 4/1955 | Sweden | 403/211 |

*Primary Examiner*—Peter A. Aschenbrenner
*Attorney, Agent, or Firm*—Armstrong, Nikaido, Marmelstein & Kubovcik

[57] ABSTRACT

A sealing device comprising a synthetic resin case having a hollow portion, a synthetic resin string holder accommodated in the hollow portion and a string. When the opening portion of a coin containing bag is placed into a double loop portion of the string extending through the case and opposite ends of the string is then pulled, the opening portion of the bag is gathered up, and intermediate portions of the string are held by the holder within the case to seal the bag.

5 Claims, 25 Drawing Figures

DEVICE FOR SEALING COIN CONTAINING BAG OR THE LIKE

The present invention relates to a device for sealing coin containing bags and the like.

Large quantities of coins are daily collected, for example, by bus companies operating one-man buses. Since it is very cumbersome to manually count up such a large amount of coins at the bus company, it is general practice for the bank clerk to bring bags to the bus company, pack the coins into the bags, close each of the bags with a sealing device, bring the sealed coin bags back to the bank and thereafter calculate the total sum of the coins by an automatic coin counter. For sealing such coin containing bags, a device is already known which comprises a single string and a rectangular block made of lead and having string insertion holes arranged in parallel. The bag is sealed with this device by passing the string through the holes to form a loop with the string, fitting the opening portion of the bag into the loop, pressing the block against the bag opening portion and thereafter crimping the block. The bag sealing procedure requires a punch or like tool for crimping the rectangular lead block, is therefore very troublesome and needs skill because the block must be crimped with both ends of the string held taut by hand. Thus, the device has the problem that it is not usable easily by everybody. The known device is discarded after use, but since the block of the device is made of lead which is a heavy metal, disposal of a large amount of blocks involves the problem of causing pollution.

An object of the present invention is to overcome the above problems and to provide a device for sealing a coin containing bag or the like.

The device of the present invention for sealing a coin containing bag or like article is characterized in that the device comprises a case having opposite side walls defining a hollow portion, a string holder accommodated in the hollow portion and a string, the case side walls having inner surfaces inclined inward toward the front to define the hollow portion, at least one of each side wall of the string holder and each of the case side walls being provided with at least one string holding projection, the string being folded back approximately at its midportion of required length with the folded portion in engagemwnt with the string holder, the portion of the string at one side of the string holder extending outward from a front portion of the case to form a first loop for gathering up the article, an intermediate part of the string portion extending into the hollow portion through the front portion of the case and being positioned between the string holder and one of the case side walls, the leading end of the string portion extending outward from a rear portion of the case, the portion of the string at the other side of the string holder extending outward from the front portion of the case to form a second loop for gathering up the article, an intermediate part of the second-mentioned string portion extending into the hollow portion through the front portion of the case and being positioned between the string holder and the other case side wall, the leading end of the second-mentioned string portion extending outward from the rear portion of the case, whereby when the ends of the string outside the rear portion of the case are pulled with the article fitted in the first and second loops, the first and second loops are both reduced in size to gather up the article, permitting the string holder to be advanced along with along with the folded string portion as the two loops are reduced to the smallest size by pulling to eventually hold the string at required intermediate portions thereof.

With use of the device of the present invention, the opening portion of a coin containing bag or like article can be sealed by hand very easily and reliably without using a punch or like tool. In fact, the sealing device does not require any skill but is usable by anyone with extreme ease. Furthermore, the sealing device, which can be prepared from synthetic resin, has the advantage that it can be incinerated after use without entailing the conventional problem of pollution due to the use of lead.

Figure 15:
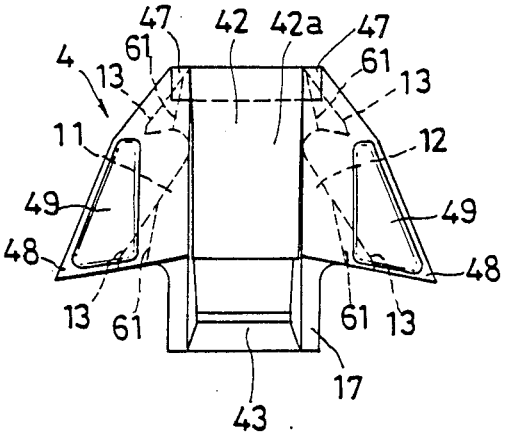
Figure 16:
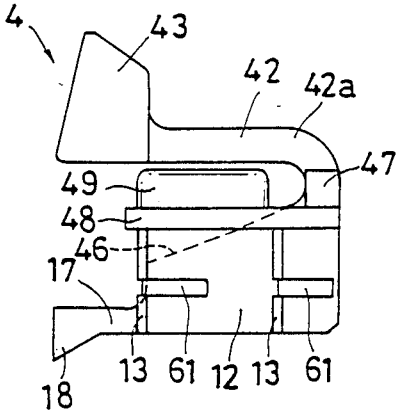
Figure 17:
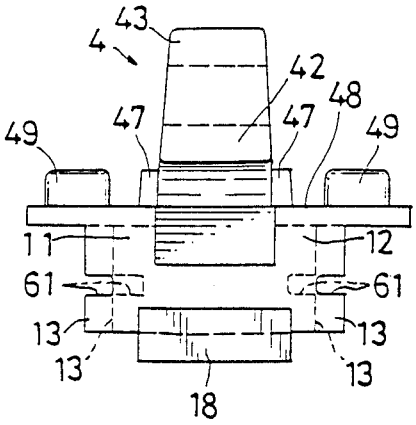
Figure 20:
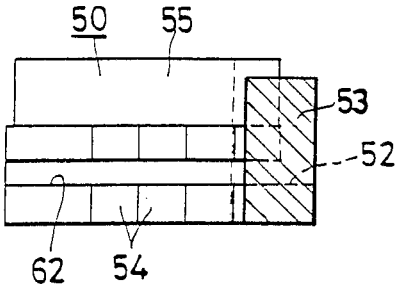
Figure 18:
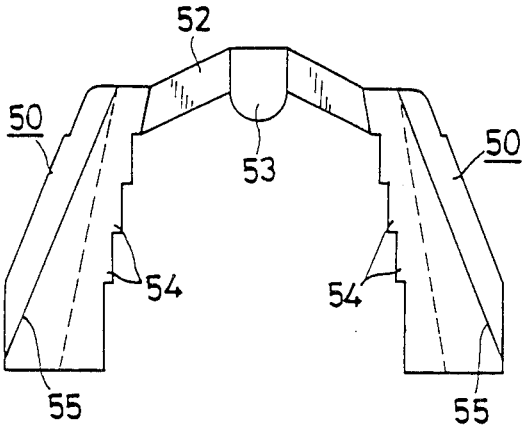
Figure 19:
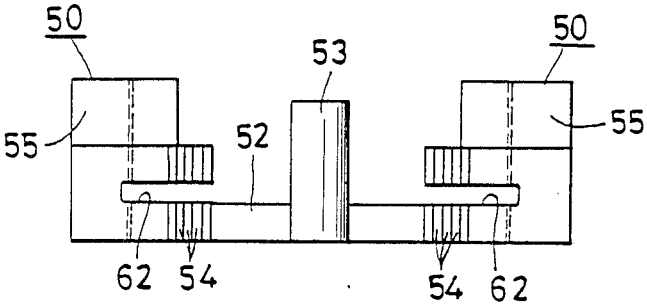
Figure 21:
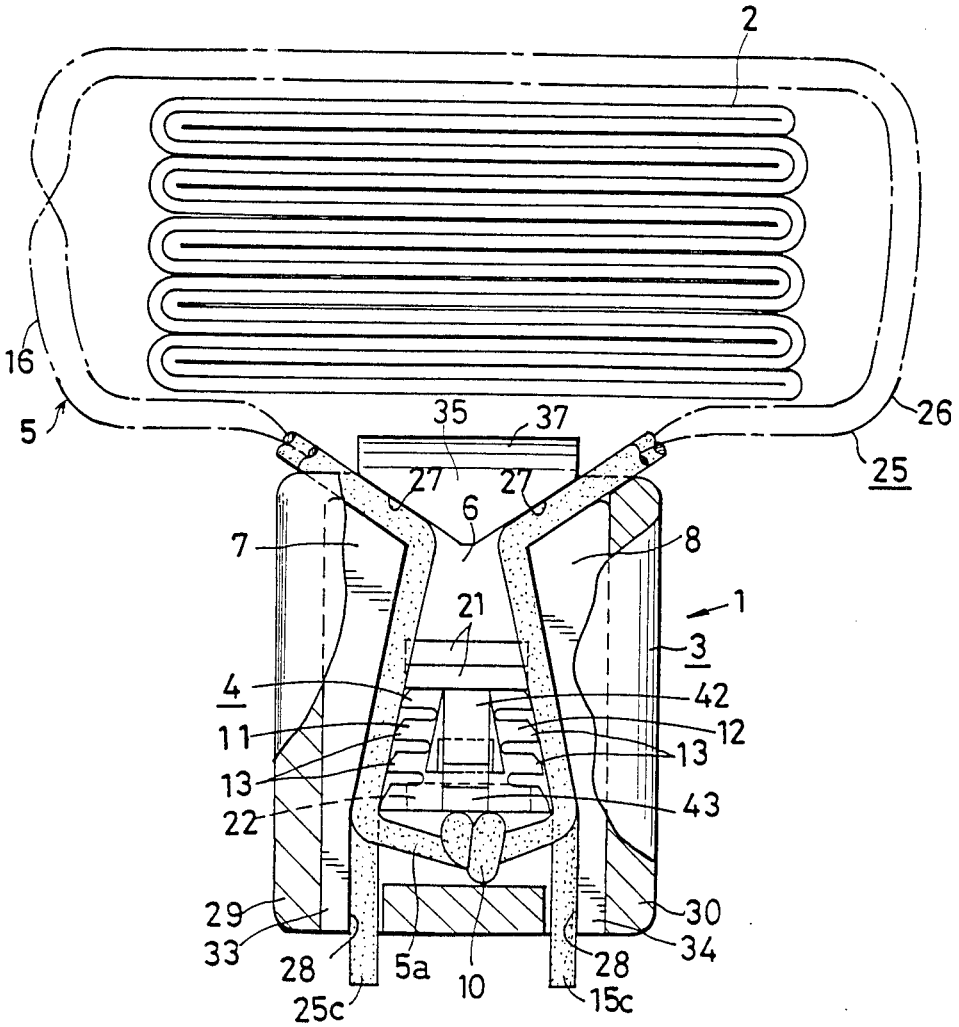
Figure 22:
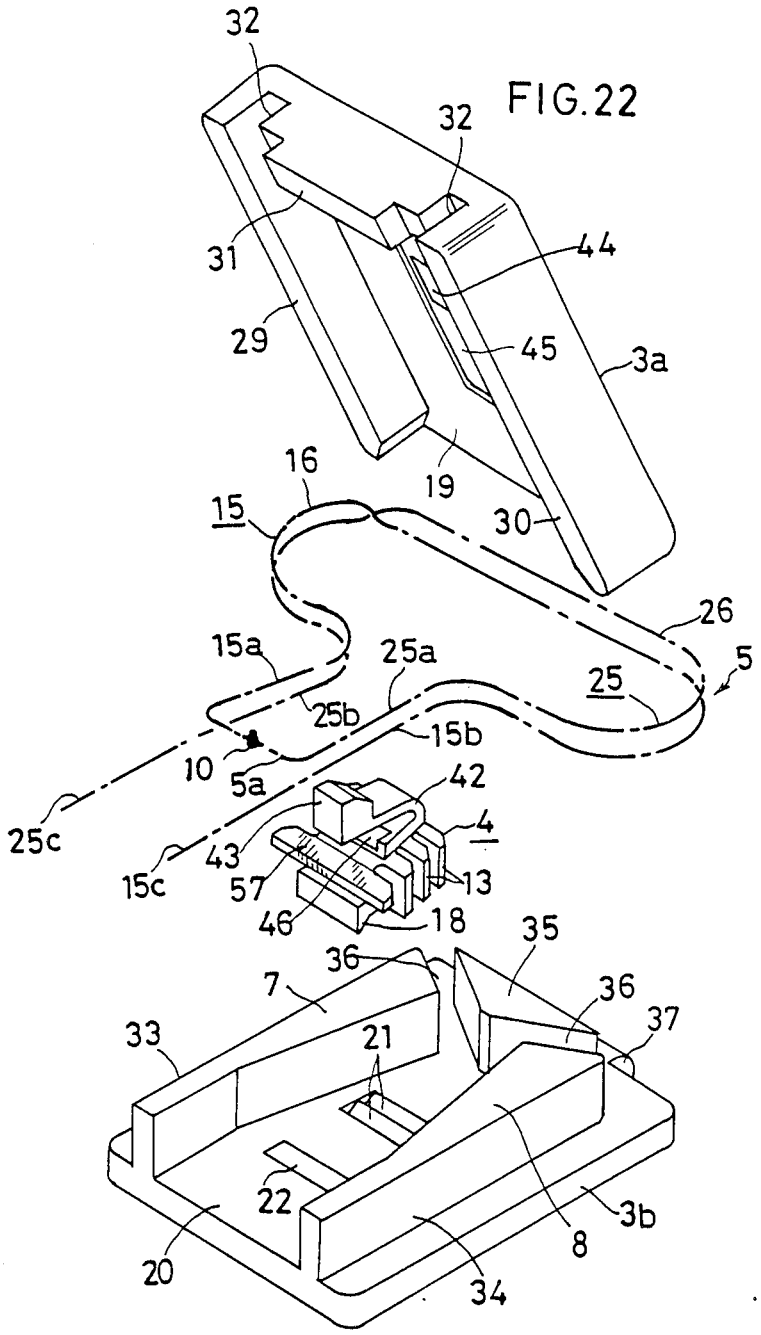
Figure 23:
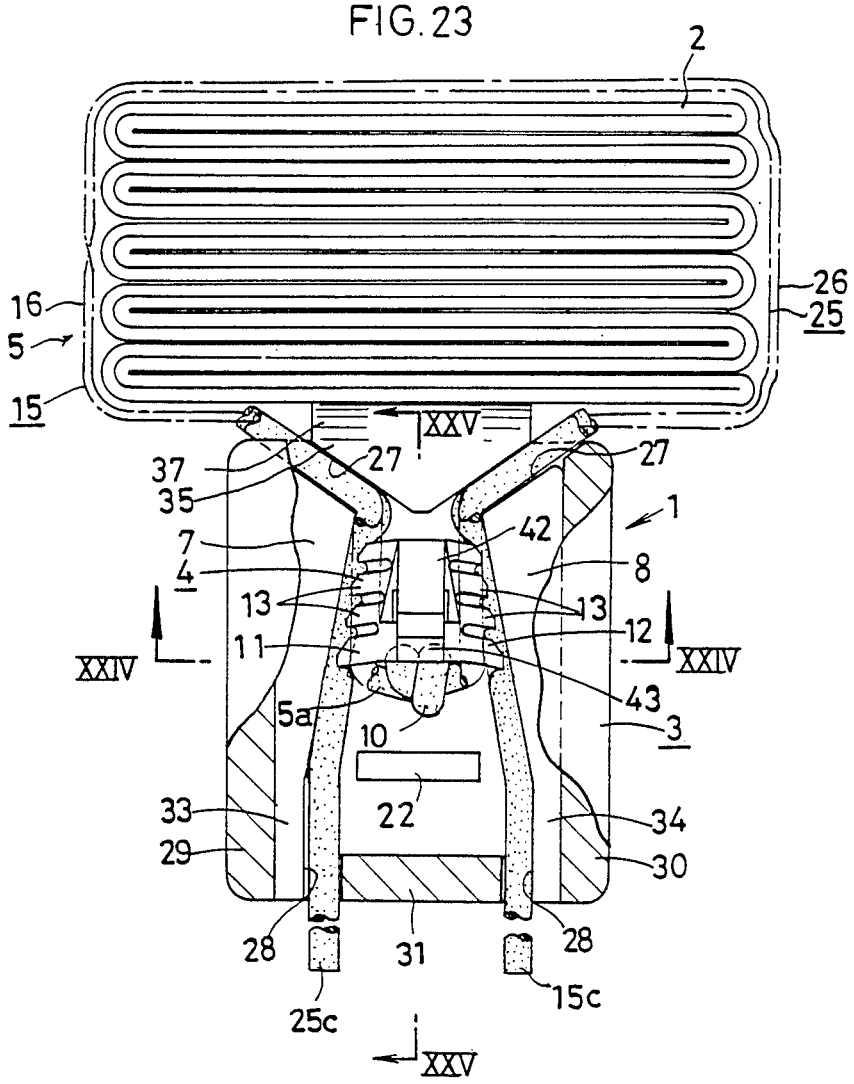
Figure 24:
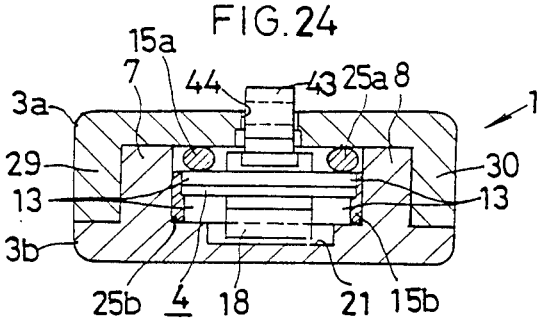
Figure 25:
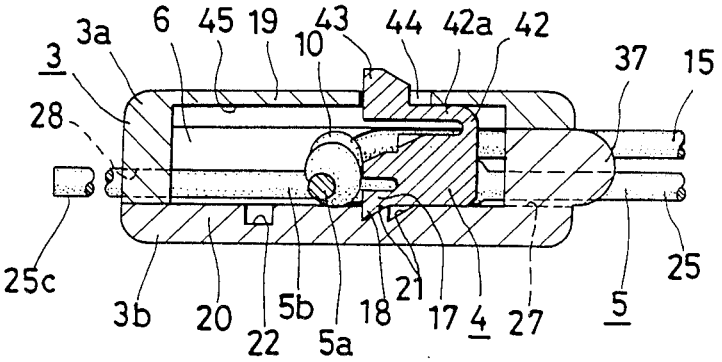

FIG. 15 a plan view of a string holder of the sealing device;

FIG. 16 is a right side elevation of the same;

FIG. 17 is a rear view of the same;

FIG. 18 is a plan view of the wedges;

FIG. 19 is a rear view of the same;

FIG. 20 is a view of the same in section taken along the longitudinal center line thereof;

FIG. 21 is a plan view partly broken away and showing another embodiment of the invention before sealing;

FIG. 22 is an exploded perspective view showing the same;

FIG. 23 is a plan view of the same after sealing;

FIG. 24 a view in section taken along the line XXIV—XXIV in FIG. 23; and FIG. 25 is a view in section taken along the line XXV—XXV in FIG. 24.

Figure 1:
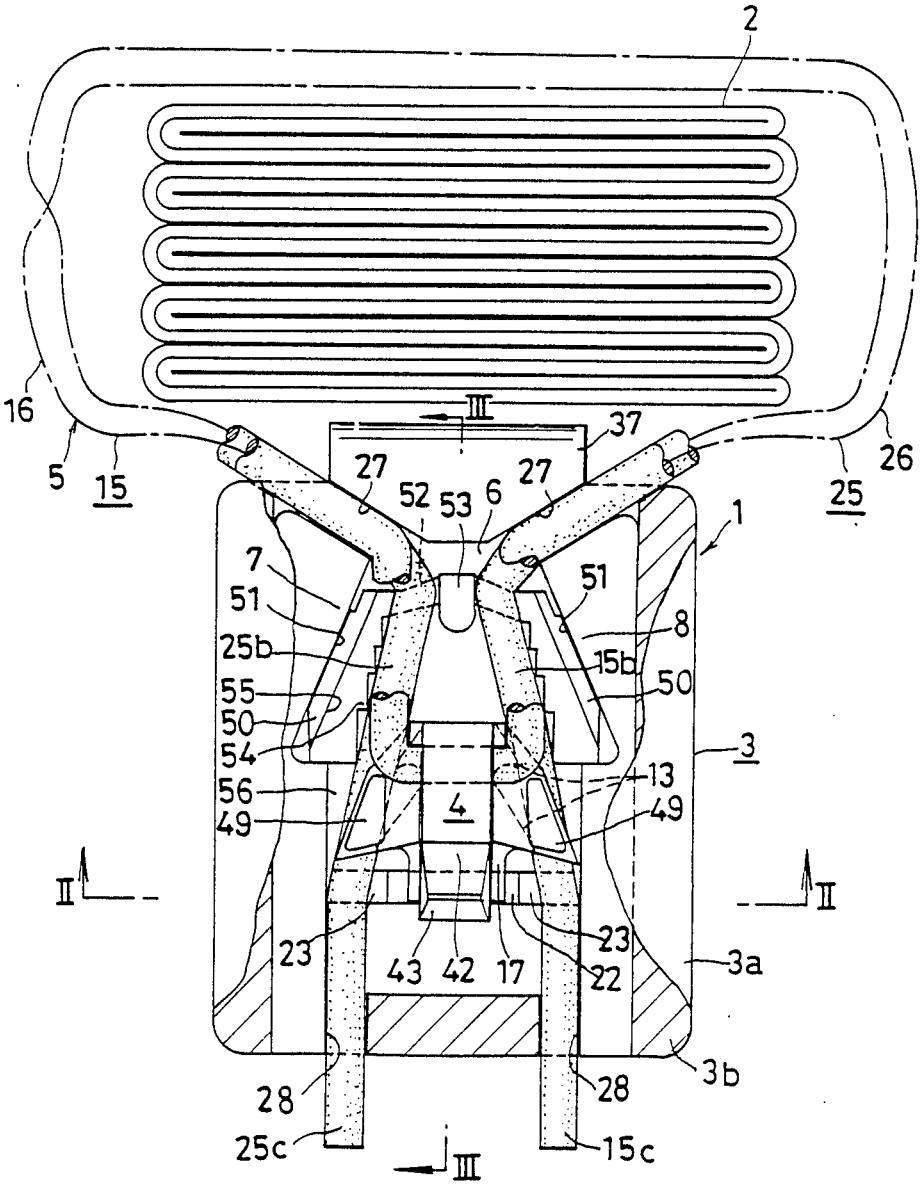
FIG. 1 is a plan view partly broken away and showing an embodiment of sealing device of the invention before sealing.

Throughout the specification, the terms "front", "rear", "right", "left", "upper" and "lower" are based on FIG. 1. "Front" refers to the upper side of FIG. 1, "rear" to the lower side thereof, "right" to the right side thereof and "left" to the left side thereof. "Upper" refers to one side of the plane of the same drawing toward the viewer, and "lower" to the other side thereof away from the viewer.

With reference to FIGS. 1 to 20, a device 1 for sealing a coin containing bag 2 or the like comprises a small box-shaped case 3 made of a synthetic resin and having a hollow portion 6, a string holder 4 made of Duracon or like synthetic resin and accommodated in the hollow portion 6, a pair of wedges 50, 50 made of ABS or like synthetic resin, arranged on opposite sides of the holder 4 and interconnected by a connecting strip 52, and a single string 5, for example, in the form of a round nylon string.

The string holder 4 is generally trapezoidal when seen from above and has right and left opposite side walls 12, 11 and two string holding projections 13 on each of the side walls. A string engaging groove 61 is formed in the end of each holding projection 13, such that a required intermediate portion of the string 5, when held by the projections 13 of the holder 4, is partly engaged in the grooves 61.

The case 3 has right and left opposite side walls 8, 7 defining the hollow portion 6 and having inner surfaces which are inclined inward toward the front. A wedge fitting recess 51 is formed in each of these side walls 7, 8. The wedges 50, 50 which are tapered toward their front ends are fitted in these recesses 51, 51, respectively. Since the recesses 51 are longer than the wedges 50, the wedges 50 are movable forward or rearward relatively freely in the recesses 51. The rear end lower side of the string holder 4 is provided with a thin portion 17 which has a detent projection 18 at its free end. The bottom wall 20 of the case 3 defining the hollow portion 6 is formed with two engaging cavities 21 for the detent projection 18 to fit in and a standby cavity 22 positioned to the rear of these cavities and provided for the projection 18. The bottom wall of the standby cavity 22 and the bottom walls of the engaging cavities 21 are inclined upward toward the front. The two engaging cavities 21 are arranged adjacent to each other. While the detent projection 18 fits in the rear engaging cavity 21 for sealing, the string holder 4 is movable forward when the string 5 is pulled by a greater force. When the holder 4 advances to the foremost position, the front end of the holder 4 comes into contact with a stopper 53 on the connecting strip 52, whereby the holder 4 is prevented from moving further forward.

The bottom wall 20 of the case 3 has string positioning projections 23, 23 at opposite sides of the standby cavity 22. The string 5 is raised by these projections 23, 23 on opposite sides of the holder 4 and thereby prevented from entering a space under the holder 4.

A resilient support member 42 which is generally in an inverted L-shape when seen from one side is provided on an upper wall of the holder 4. The support member 4 has an arm portion 42*a* which has at its free end a sealed state indicator projection 43 biased outward. The case 3 has a top wall 19 adjacent the projection 43 and formed at a specified portion with a sealed state indicator window 44 for the projection 43 to fit in. A groove 45 for guiding the projection 43 and the arm 42*a* of the support member 42 is formed in the inner surface of the top wall 19 and extends forward and rearward from the window 44 in alignment therewith. Before sealing, the projection 43 and the front end of the arm 42*a* are fitted in the guide groove 45. The string holder 4 has an upper surface 46 slanting rearwardly downward. The presence of the slanting surface 46 permits the arm 42*a* of the support member 42 to be positioned inside the case 3 before sealing. Small projections 47, 47 which are square when seen from above for preventing rise of the string holder 4 are provided on the front end of the holder 4 on opposite sides of bent front end of the support member 42. The upper ends of these projections 47 are opposed to, and spaced by a small clearance from, the portions of the top wall 19 at opposite sides of the guide groove 45. When the front end of the arm 42*a* of the support member 42 which is integral with the holder 4 passes immediately below the window 44 with the advance of the holder 4 as will be described later, the rise preventing projections 47 prevent the arm front end from fitting into the window 44.

The string holder 4 has at each side thereof a string spacing flange 48 in the form of a thin wing. The flange 48 serves to separate the portions of the string 5 to be positioned one above the other at each side of the holder 4 and also to prevent rotation of the string holder 4 within the case 3 in the case where a deflecting force acts on the holder 4 when the string 5 is pulled. The flange 48 has a rise preventing projection 49 at its free end.

The wedges 50, 50 are interconnected by the strip 52 of small thickness at their front ends. The stopper 53, projecting rearward, is provided at the midportion of the connecting strip 52. When a great tensile force acts on the string 5 while the bag 2 is in its sealed state, the stopper 53 prevents the string holder 4 from moving forward together with the wedges 50, 50. The wedge 50 is provided with four string holding projections 54 on its inner side to be in contact with the string. A string engaging groove 62 is formed in the end of each holding projection 54. A string passing cutout 55 is formed at the upper inner edge of the wedge 50. Each of the side walls 7, 8 defining the hollow portion 6 is provided on its inner side with a stepped portion 56 in the rear of the wedge fitting recess 51. The stepped portion 56 is provided to facilitate insertion of the string 5 through the case and to render the free end of the flange 48 free of interference with the side wall.

Figure 2:
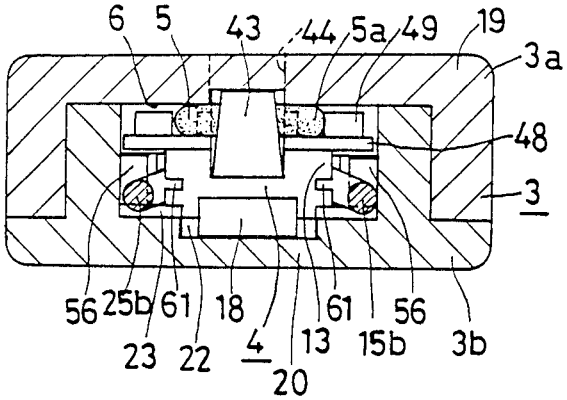
FIG. 2 is a view in section taken along the line II—II in FIG. 1.
Figure 3:
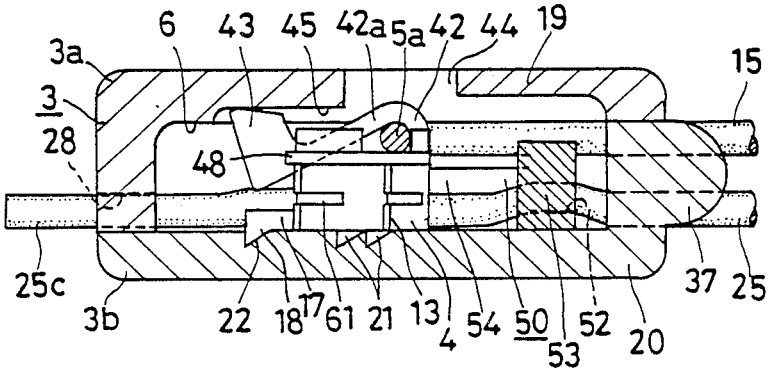
FIG. 3 is a view in section taken along the line III—III in FIG. 1.
Figure 5:
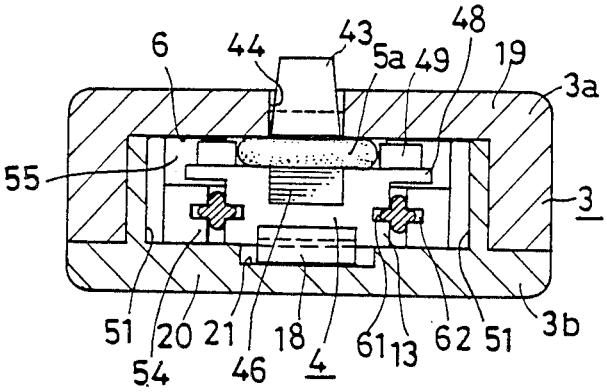
FIG. 5 is a view in section taken along the line V—V in FIG. 4.
Figure 4:
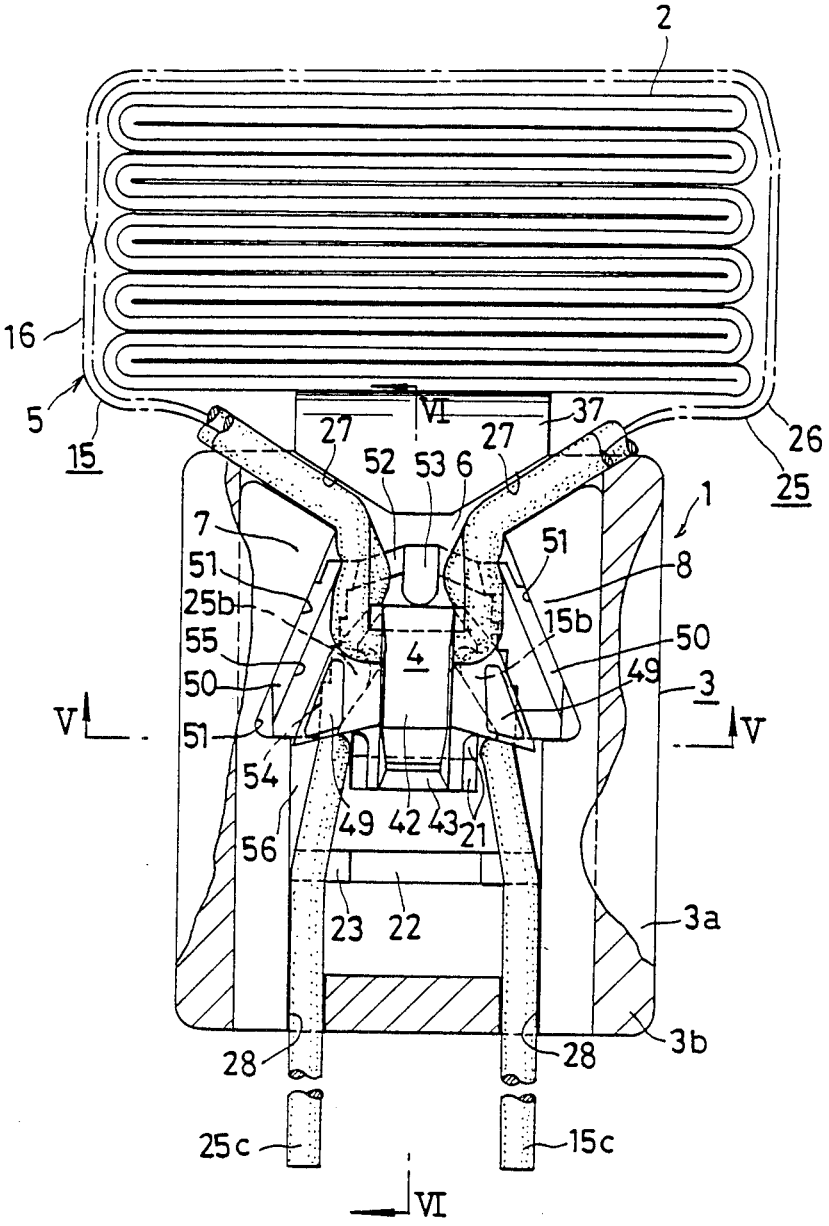
FIG. 4 is a plan view partly broken away and showing the device after sealing.
Figure 6:
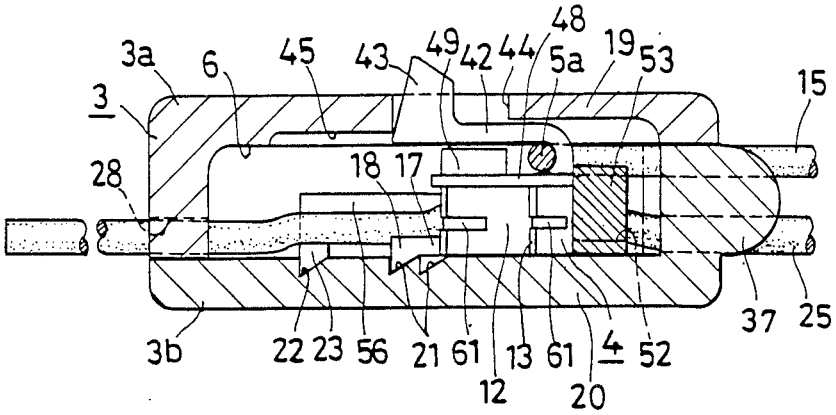
FIG. 6 is a view in section taken along the line VI—VI in FIG. 4.
Figure 7:
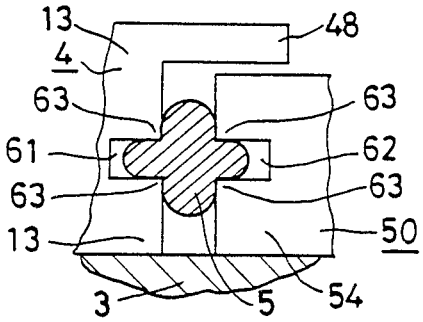
FIG. 7 is an enlarged fragmentary view in section showing a clamped intermediate portion of a string.

As seen in FIGS. 1 to 3, the string 5 is folded back at its midportion of required length as at 5*a*, and the folded portion 5*a* is fitted to the support member 42 at the front end of the string holder 4. The portion 15 of the string at one side of the string holder 4 extends outward from the case 3 through a string hole 27 in the front portion of the case at the left side to form a first loop 16 for gathering up the bag 2. An intermediate part 15*b* of the string portion 15 extends into the hollow portion 6 through a string hole 27 in the front portion of the case 3 at the right side and is positioned between the holder 4 and the right wedge 50. The leading end 15*c* of the string portion 15 extends outward from the case 3 through a string hole 28 in the rear portion of the case at the right side. The portion 25 of the string at the other side of the holder 4 extends outward from the case 3 through the hole 27 in the front left portion thereof to form a second loop 26 for gathering up the bag 2. An intermediate part 25*b* of the string portion 25 extends into the hollow portion 6 through the front left string hole 27 and is positioned between the holder 4 and the left wedge 50. The leading end 25*c* of the string portion 25 extends outward from the case 3 through the rear left string hole 28.

At opposite sides of the string holder 4, the starting ends 15*a*, 25*a* of the string portions 15, 25 close to the folded portion 5*a* are positioned above the intermediate portions 15*b*, 25*b*. Since the starting ends 15*a*, 25*a* of the string portions 15, 25 need not be held in place for sealing, they are positioned in the string passing cutouts 55, 55 of the wedges 50, 50. The intermediate parts 15*b*, 25*b* of the string portions 15, 25, which are to be held in place for sealing, are positioned between the string holding side projections 13 of the holder 4 and the string holding projections 54 of the wedges 50, 50.

A projection 37 semicircular in cross section for preventing the string from loosening is formed on the front end of the case 3. The projection 37 serves to reduce the area of contact between the case 3 and the bag 2 in the sealed state to thereby prevent the string 5 from being loosened by upward and downward movement of the case 3. Accordingly the projection 37 is not limited to the semicircular form but can be generally triangular in cross section. Alternatively the front end of the case 3 may be arcuate or triangular in cross section in its entirety.

The case 3, which is made of a synthetic resin such as ABS, comprises an upper half segment 3*a* and a lower half segment 3*b* which are molded and thermally fused together as shown in FIGS. 11 to 14. The upper segment 3*a* is rectangular when seen from above and has vertical portions 29, 30 at its opposite sides and a rear wall 31 at its rear end. Clearances 32, 32 of required width are formed between the rear wall 31 and the two vertical portions 29, 30. The lower segment 3*b* is rectangular, has the same size as the upper segment 3*a* and includes a pair of upright portions 33, 34 toward its opposite sides and a front wall 35 in the middle of its front end, the front wall being generally triangular when seen from above. Between the front wall 35 and the front ends of the upright portions 33, 34 are formed clearances 36, 36 each so sized as to pass two lengths of string. These clearances are arranged in a V-form. The bottom wall of the lower segment 3*b* provides the bottom wall 20 of the case 3 defining the hollow portion 6. The standby cavity 22 and the detent cavities 21 to the front thereof are formed in the upper surface of the bottom wall of the lower segment 3*b* toward its rear end. The opposed upright portions 33, 34 of the lower segment 3*b* provide the side walls 11, 12 of the case 3. The wedge fitting recesses 51, 51 are formed in these portions on the inner side thereof toward their front ends. The loosening preventing projection 37 is formed on the lower segment 3*b*.

When the upper segment 3*a* is fitted to the lower segment 3*b*, with the vertical portions 29, 30 positioned outside the upright portions 33, 34, the hollow portion 6 is defined by the two segments 3*a*, 3*b*, and the string holes 27, 27 communicating with the front end of the hollow portion 6 are formed at opposite sides of the front wall 35. The rear wall 31 of the upper segment 3*a* is positioned between the rear ends of the opposed upright portions 33, 34 to form the string holes 28, 28 between the rear wall 31 and the upright portions 33, 34 in communication with the rear end of the hollow portion 6. The vertical portions 29, 30 and the upright portions 30, 34 form the side walls of the case 3.

The string holder 4, the pair of wedges 50, 50 interconnected by the strip 52 and the string 5 are placed between the upper and lower segments 3*a*, 3*b* in the arrangement shown in FIG. 1, and the lower surfaces of the vertical portions of the upper segment 3*a* are thermally fused to the bottom wall of the lower segment 3*b* at its opposite side portions by an unillustrated device, whereby the upper and lower segments 3*a*, 3*b* are joined together to form the case 3. Thus, the holder 4, the pair of wedges 50, 50 and the string 5 are incorporated in the case 3 in the specified arrangement to provide the sealing device 1.

The sealing device 1 is small and measures, for example, 2 cm in length, 1.6 cm in width and 0.6 cm in thickness. It is used in the following manner.

With reference to FIGS. 1 to 3, the string holder 4 is positioned in the rear portion of the case 3 before sealing. The detent projection 18 of the holder 4 is fitted in the standby cavity 22 in the bottom wall 20 of the case, and the sealed state indicator projection 43 is held retracted within the case 3 against the resiliency of the support member 42. The wedges 50, 50 are relatively freely fitted in the recesses 51, 51 of the side walls 7, 8 of the case 3. The connecting strip 52 is positioned in front of the holder 4. The first and second loops 16 and 26 extend through the case 3 as if in the form of a double loop.

With the opening portion of the coin containing bag 2 placed in the first and second loops 16, 26, the ends 15*c*, 25*c* of the string 5 disposed outside the rear portion of the case 3 are pulled. This diminishes the first and second loops 16, 26 to gather up the opening portion of the bag 2 with these loops 16, 26. When the loops 16, 26 are reduced to the smallest size by pulling, the holder 4 is advanced with the folded string portion 5*a* as shown in FIGS. 4 to 7. The wedges 50, 50 at opposite sides of the holder 4 are relatively free in the recesses 51, 51 of the case 3. If the wedges 50, 50 are initially in contact with the rear walls of the recessed portions 51, 51, they remain at rest. However, if the wedges 50, 50 are positioned toward the front in the recesses 51, 51, the wedges 50, 50 are retracted along the inclined inner surfaces of the case side walls 7, 8 by the reaction resulting from the advance of the holder 4, with the result that the wedges 50, 50 are brought into contact with the rear walls of the recessed portions 51, 51.

With the advance of the string holder 4, the intermediate parts 15*b*, 25*b* of the string 5 are clamped between the opposed side walls 11, 12 of the holder 4 and the wedges 50, 50 and held by the holding projections 13, 54. Because the string intermediate portions 15*b*, 25*b* are partly engaged in the grooves 61, 62 and pressed on by the sharp corners 63 at opposite sides of the grooves 61, 62, the string is tightly held in place.

When the string holder 4 is advanced by pulling the string ends 15*c*, 25*c*, the string intermediate portions 15*b*, 25*b* partially engage in the grooves 61, 62, so that the force for pulling the string 5 can be small.

On the other hand, the detent projection 18 of the holder 4 is forced inward along with the thin portion 17 by virtue of the resiliency of the portion 17 and is thereafter fitted into the engaging cavity 21. With the projection 18 engaged by the rear wall of the cavity portion 21, the holder 4 is prevented from retraction, whereby the bag 2 is completely sealed. At the same time, the sealed state indicator projection 43 is fitted into the window 44 of the case 3 by the resilient force of the support member 42. This indicates that the bag has been sealed. In this state, the front end of the string holder 4 bears against the end of the stopper 53 on the connecting strip 52, whereby the holder 4 is restrained from moving further forward.

Figure 9:
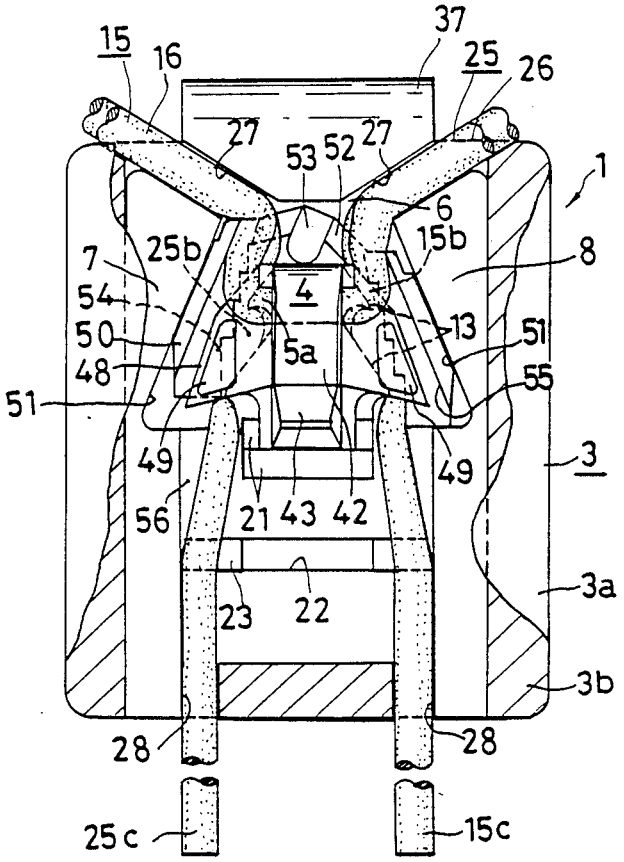
FIG. 9 is a plan view partly broken away of the device to show a wedge which is moved when a portion of the string is pulled by a bag after sealing.
Figure 10:
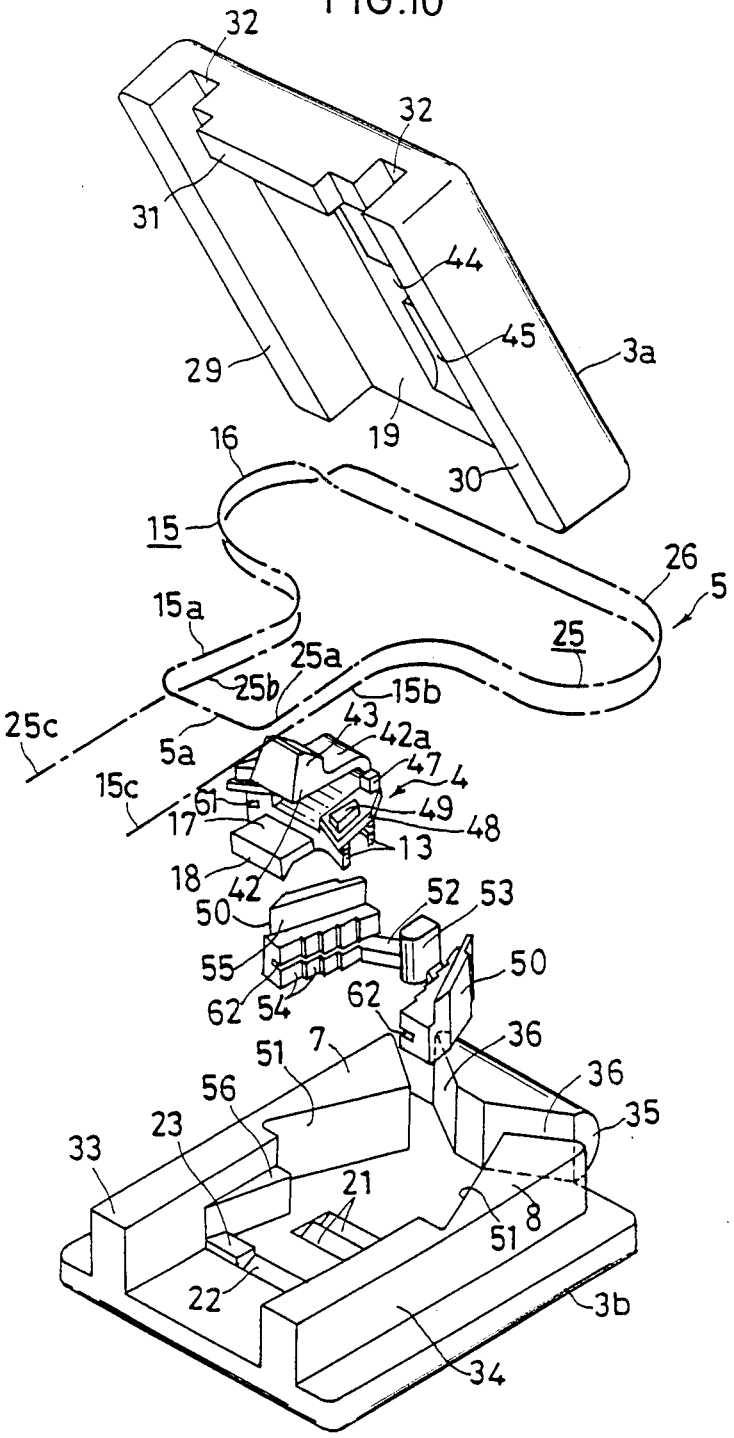
FIG. 10 is an exploded perspective view of the sealing device.
Figure 11:
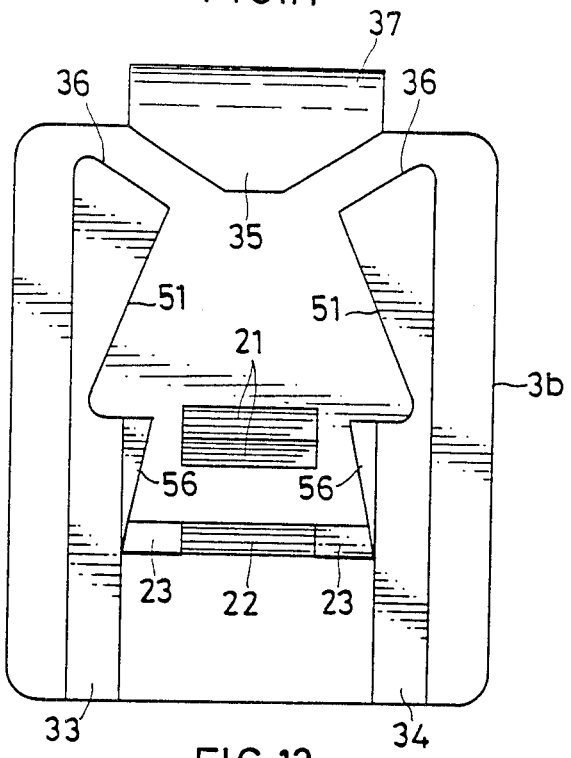
FIG. 11 is a plan view showing the lower half segment of a case of the device.
Figure 12:
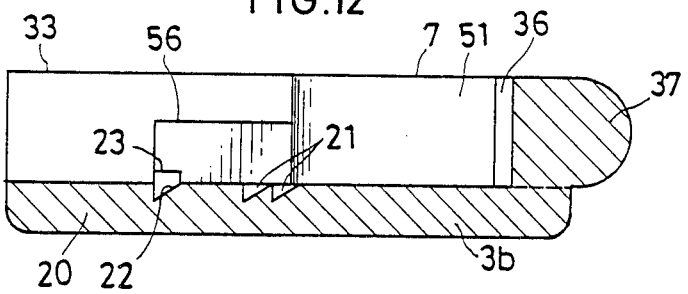
FIG. 12 is a view of the lower segment in section taken along the longitudinal center line thereof.
Figure 13:
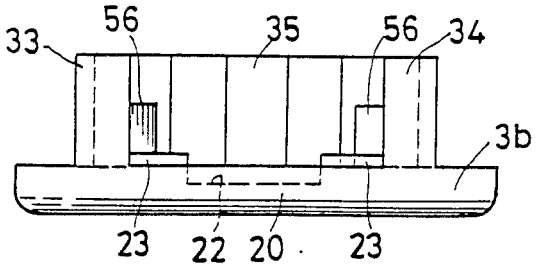
FIG. 13 is a rear view of the lower segment.
Figure 14:
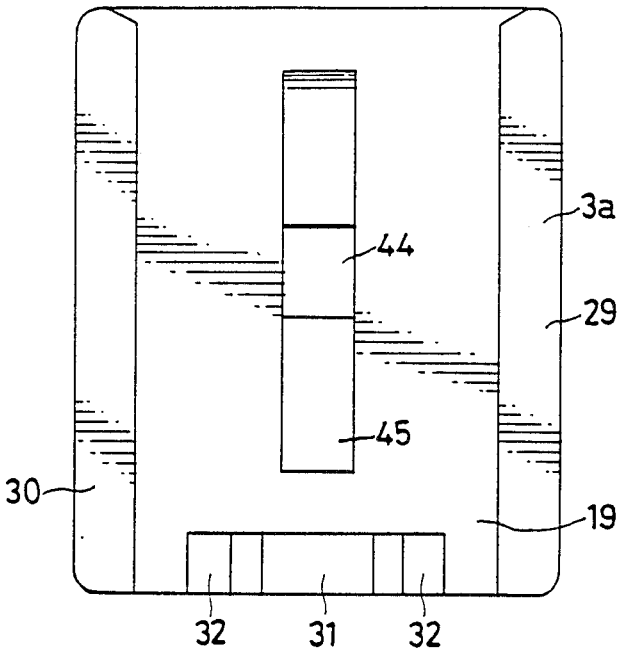
FIG. 14 is a bottom view of the upper half segment of the case.

If one of the string portions 15, 26 of the loops 16, 26, e.g. the portion 25 only is strongly pulled by the bag 2 when the string 5 is in this sealing state, the wedge 50 in pressing contact with the intermediate part 25*b* of the string portion 25 is slightly advanced along the side wall 7 of the case 3 owing to the friction between the wedge and the string 5 as seen in FIG. 9, so that the intermediate part 25*b* is held more tightely by a secondary force. Accordingly the string portion 25 will not be pulled out toward the bag 2 to any extent.

Because the end of the stopper 53 on the connecting strip 52 is in contact with the front end of the holder 4 in this case, the holder 4 is prevented from moving forward along with the wedge 50. This in no way allows the string 5 to loosen to assure perfect sealing.

The stopper 53, which is provided on the strip 52 according to the above embodiment, may be provided conversely on the front end of the holder, with the end of the stopper adapted to come into contact with a side portion of the connecting strip 52.

Figure 8:
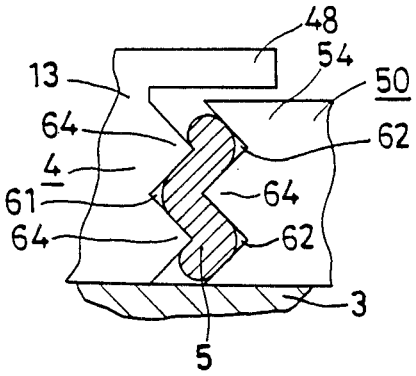
FIG. 8 is an enlarged fragmentary view in section showing a modification of the arrangement of FIG. 7.

Although one engaging groove 61 (62), U-shaped in cross section, is formed in each holding projection 13 (54) in the foregoing embodiment, one or two grooves 61 or 62, V-shaped in cross section, may be alternatively provided as seen in FIG. 8. In this case, the string intermediate portions 15*b*, 25*b* engage in the grooves 61, 62 and are firmly held by sharp projections 64 defining the grooves 61, 62. The grooves 61, 62 may be shaped otherwise in cross section.

FIGS. 21 to 25 show another embodiment of sealing device according to the invention, wherein the wedges 50, 50 are not provided within the case 3. When sealing a coin containing bag 2, intermediate portions 15*b*, 25*b* of a string 5 are held between string holding projections 13 on the string holder 4 and opposite side walls 7, 8 of the case 3 defining a hollow portion 6. Four relatively long holding projections 13 are provided on each side of the holder 4 in an arrangement resembling the backbone of fish. The rearmost string holding projections 13, 13 have a relatively small thickness and are therefore unable to hold the string effectively. However, these rearmost projections 13, 13 are provided to prevent the holder 4 from rotating in the case 3 even when the string portion at one side is pulled more strongly when the string 5 is tightened up.

The base portion rear end of the support member 42 has a slanting surface 46 slanting downward toward the rear, and the rearmost holding projections 13, 13 also have a slanting upper surface 57 as if the surface were an extension of the surface 46. By virtue of these slanting surfaces 46, 57, the arm 42*a* of the support member 42 can be properly held retracted within the case 3 in the state shown in FIG. 1.

At the midportion of the required length of the string 5, a knot 10 is formed for preventing displacement of the string 5. The string 5 is folded back at the knot 10 as indicate at 5*a*, and the folded portion is in engagement with the rear wall of the holder 4. In the sealing state wherein the sealed state indicator projection 43 is fitted in the window 44 of the case 3 by the resiliency of the support member 42, the knot 10 is positioned under the projection 43, so that the projection 43 can be raised by the knot 10 effectively. Consequently the projection 43 as fitted in the window 44 will not be retracted into the case 3 even if depressed from outside by some pressure.

In the above embodiments, the first loop 16 of the string 5, as well as the second loop 26, is fitted around the opening portion of the bag 2 by only one turn as shown, but the string may be wound around the bag two or more turns to form such loops for sealing.

Although the sealed state indicator projection 43 is attached to the string holder 4 by the support member 42 which is generally in an inverted L-form when seen from one side, some other support member having resiliency may be used for attaching the projection 43 to the holder 4. The projection 4 may be shaped as desired. The projection 43, which is mounted on the upper wall of the holder 4, may alternatively be mounted on the lower wall of the holder 4. In this case, the detent projection 18 will be provided on the upper wall or can be dispensed with. Of course the indicator window 44 is formed in the top wall 19 or bottom wall 20 of the case 3 in corresponding relation to the projection 43.

While the case 3 comprises the upper segment 3*a* and the lower segment 3*b* which are fused together, the segments may be joined together with use of an adhesive or solvent. The case 3 can be molded as an integral piece. Although the illustrated case is box-shaped, a hollow cylindrical or frustoconical case is of course usable. The case 3 and the string holder 4, which are made of a synthetic resin, may be prepared from some other material. The string 5, which is made, for example, of nylon, may be prepared from other synthetic fibers or hemp. Further a knot formed at the midportion of the required length of string 5 may be engaged with the rear wall of the string holder 4.

The single string 5 is used as folded back because the string 5 can then be held around the holder 4 conveniently. Accordingly two strings which have approximately the same length are of course usable in embodying the present invention, such that one end of each string is attached to the holder 4 to form a loop with each string.

Although two or four string holding projections are provided on each side wall of the holder 4 with the foregoing embodiments, at least one holding projection 13 may be formed on each holder side wall. The wedge 50, when used, may be planar on the inner side thereof to be in contact with the string. The string holding projection 13 is not limited to the illustrated shape but can be shaped otherwise suitably.

The thin portion 17 and the detent projection 18, which are provided at the rear lower portion of the holder 4 according to the embodiments described, may be provided at least at one of the front upper and lower portions and rear upper and lower portions of the holder 4. In corresponding relation to the detent projection 18 on the holder 4, the engaging cavities 21 are formed in the desired portion of the top or bottom wall 19 or 20 of the case 3. Although two engaging cavities 21 are shown, one cavity or at least three cavities may be formed. The cavities are arranged in succession in the front-to-rear direction.

According to the illustrated embodiments, the predetermined portions of the string 5 extend outward from the case 3 through the holes 27, 27 formed at opposite sides of the case front wall 35 and through the holes 28, 28 formed at opposite sides of the case rear wall 31. These holes may be formed at the front and rear portions of the case 3 in the top and rear walls or opposite side walls of the case.

Although the sealing device 1 of the invention has been described as it is used for sealing coin containing bags 2, the present device 1 is usable also for sealing various other articles.

I claim:

1. A device for sealing a coin containing bag or the like article comprising:

(a) a case having front, rear, upper, lower, right and left side walls defining a hollow portion in said case, (b) a string holder block member disposed in said hollow portion for movement toward the front portion of said case along right and left tapered walls thereof, (c) a string of required length to enclose the bag having a midportion and two free ends, (d) portions of said left and right side walls tapering toward the front of the case adjacent said string holder block member, (e) a support surface on said block member defining a string holder for engagement with said string, (f) a midportion of said string in engagement with said support surface, (g) a first portion of said string extending from the midportion through said hollow portion outward from the front of the case to form a first loop to enclose the article and thence bask into the hollow portion of said case through the lower front portion thereof and being positioned between a side wall of the case and said block member with its free end extending outward from the rear end of said case, (h) a second portion of said string extending from the midportion through said hollow portion outward from the front of the case to form a second loop to enclose the article and thence back into the holow portion through the lower front portion thereof and being positioned between a side wall of the case and said block member with its free end extending outward from the rear end of said case, whereby pulling the free ends of said string decreases the size of said first and second loops and tightly encloses the article, (i) means to secure said first and second portions of its string and midportion to the string holder block member after the free ends of the string have been pulled tight to seal said articles and (j) said string holder block member including a detent projection facing the lower wall of said case, and at least one engaging cavity for the detent projection to fit in formed in the lower wall of said case.

2. A device for sealing a coin containing bag or like article comprising:

(a) a case having front, rear, upper, lower, right and left side walls defining a hollow portion in said case, (b) a string holder block member disposed in said hollow portion for movement toward the front wall of said case along right and left tapered walls thereof, (c) a string of required length to enclose the bag having a midportion and two free ends, (d) portions of said left and right side walls tapering toward the front of the case adjacent said string holder block member, (e) a support surface on said block member defining a string holder for engagement with said string, (f) a midportion of said string in engagement with said support surface, (g) a first portion of said string extending from the midportion through said hollow portion outward from the front of the case to form a first loop to enclose the article and thence back into the hollow portion of said case throught the lower front portion thereof and being positioned between a side wall of the case and said block member with its free end extending outward from the rear end of said case, (h) a second portion of said string extending from the midportion through said hollow portion outward from the front of the case to from a second loop to enclose the article and thence back into the hollow portion through the lower front portion thereof and being positioned between a side wall of the case and said block member with its free end extending outward from the rear end of said case, whereby pulling the free ends of said string decreases the size of said first and second loops and tightly encloses the article, (i) means to secure said first and second portions of said string and its midportion to the string holder block member after the free ends of the string have been pulled tight to seal said srticle, (j) said string holder block member including a detent projection facing the lower wall of said case, and at least one engaging cavity for the detent projection to fit in formed in the lower wall of said case, and (k) said means to secure said string to said block member comprising wedge members disposed at each side of the string holder block member in the hollow portion of said case to engage and clamp portions of the string between the wedges and the string holder block member when the free ends of the spring are pulled to tighten and seal said article.

3. A sealing device as defined in claim 2 wherein the wedges are interconnected by a connecting strip disposed at the upper end of the case, and a stop means is disposed between the connecting strip and the block member, to hold the block member stationary, with portions of said string being clamped by the wedges when the free ends of the string are pulled to tighten the string and seal the article by the loops the string enclosing the article, and at least one of the wedges being movable to clamp the string more tightly when the corresponding free end of the string is further pulled.

4. A device for sealing a coin containing bag or like article comprising:

(a) a case having front, rear, upper, lower, right and left side walls defining a hollow portion in said case, (b) a string holder block member disposed in said hollow portion for movement toward the front wall of said case along right and left tapered walls thereof, (c) a string of required length to enclose the bag having a midportion and two free ends, (d) portions of said left and right side walls tapering toward the front of the case adjacent said string holder block member, (e) a support surface on said block member defining a string holder for engagement with said string, (f) a midportion of said string in engagement with said support surface, (g) a first portion of said string extending from the midportion through said hollow portion outward from the front of the case to form a first loop to enclose the article and thence back into the hollow portion of said case through the lower front portion thereof and being positioned between a side wall of the case and said block member with its free end extending outward from the rear end of said case, (h) a second portion of said string extending from the midportion through said hollow portion outward from the front of the case to from a second loop to enclose the article and thence back into the hollow portion through the lower front portion thereof and being positioned between a side wall of the case and said block member with its free end extending outward from the rear end of said case, whereby pulling the free ends of said string decreases the size of said first and second loops and tightly encloses the article, (i) means to secure said first and second portions of said string and its midportion to the string holder block member after the free ends of the string have been pulled tight to seal said srticle, (j) said string holder block member including a detent projection facing the lower wall of said case, and at least one engaging cavity for the detent projection to fit in formed in the lower wall of said case, and (k) said string holder block member including a sealed state indicator projection biased upwardly by a resilient support member, and the case including a sealed state indicator window for the indicator projection to fit in formed in the upper wall of the case in corresponding relation thereto, the indicator projection being fittable in the window when the free ends and midpoint of the string are tightened to seal the article.

5. A sealing device as defined in claim 4 wherein the wedges have recesses throught which the string passes, and the support surface of the block member is arcuate in cross section to securely grip the string.

* * * * *